United States Patent [19]

Lovett

[11] Patent Number: 4,996,636

[45] Date of Patent: Feb. 26, 1991

[54] LOW VOLTAGE LIGHT FIXTURE

[75] Inventor: Robert H. Lovett, Eden Prairie, Minn.

[73] Assignee: The Brinkmann Corporation, Dallas, Tex.

[21] Appl. No.: 486,966

[22] Filed: Mar. 1, 1990

[51] Int. Cl.[5] ..... F21S 1/10

[52] U.S. Cl. ..... 362/431; 362/226; 439/336; 439/414

[58] Field of Search ..... 362/238, 249, 226, 368, 362/431, 439; 439/414, 336, 375, 419, 616

[56] References Cited

U.S. PATENT DOCUMENTS 3,231,731 1/1966 McDonald ..... 362/226

4,768,139 8/1988 Poppenheimer ..... 362/431 X 4,774,648 9/1988 Kakuk et al. ..... 362/431 X 4,826,448 5/1989 Maddock ..... 439/414 X

*Primary Examiner*—Stephen F. Husar

*Attorney, Agent, or Firm*—Pretty, Schroeder, Brueggemann & Clark

[57] ABSTRACT

A low voltage light fixture for use with a multi-conductor wire, includes a base, a lens supported by the base, a pair of electrical conductors supported by the base which form a light bulb receptacle at their upper ends and wire engaging prongs at their lower ends, and a stake or post for supporting the base. A twist lock connector mechanism connects together the base, the stake and the wire.

21 Claims, 4 Drawing Sheets

LOW VOLTAGE LIGHT FIXTURE

BACKGROUND OF THE INVENTION

The invention relates generally to ground surface low voltage light fixtures.

Low voltage lighting systems are in widespread use to illuminate home and business landscapes. These systems generally include four basic components: (i) a transformer or power pack for converting house current to a lower AC voltage; (ii) a control system consisting of a timer and/or photoelectric cell, and optionally a manual on/off switch; (iii) a plurality of light fixtures suitable for mechanical connection to a "ground surface" through the use of a stake or post; and (iv) a wire for electrically interconnecting the components described above. The present invention pertains to a mechanism for connecting a low voltage light fixture to a stake or post.

Low voltage light fixtures generally include a light source having a base, a lens, electrical conductors, a light bulb receptacle, and a post or ground stake. The light source is then secured to an end of the stake typically by means of slide-connecting a male connector into a female connector.

Kakuk et al. U.S. Pat. No. 4,774,648, for example, discloses a low voltage light fixture having a male connector formed by outwardly-facing legs on its lower base assembly. The male connector mates with a female connector located at the top end of a stake. The female connector is formed by a pair of inwardly-facing L-shaped legs which slidably receive the outwardly-facing legs of the male connector. A pair of wire-engaging prongs extend from the base into a channel in the male connector and are connected to the light bulb of the fixture. When the fixture is attached to the stake or post wire is laid in the channel between the legs of the male connector, the male and female connectors are then engaged by sliding them together. This also results in the prongs engaging the conductors of the wire to provide electrical connection between the light bulb and the conductors of the wire. A major disadvantage of this kind of connection is that the presence of the wire in the channel make it difficult to slide the connectors together. By making the clearance between the connectors suitable for an easy sliding connection, this design also makes them easy to disconnect. The result is that the light fixture is easy to remove from the stake and is prone to theft and vandalism.

There is a continuing need for improved means for connecting a low voltage light fixture to a stake or post. The locking mechanism should be designed in such a manner that application of the means does not interfere with the interconnecting wire yet fastens the stake securely to the light source. The fixture and post must, of course, be relatively easy and inexpensive to manufacture to be commercially viable.

SUMMARY OF THE INVENTION

The present invention is connecting mechanism for a low voltage light fixture assembly adapted for use with a multi-conductor wire as a garden, landscaping, or architectural design illuminator. The assembly includes a base, a lens supported by the base, and a pair of electrical conductors supported by the base. The conductors form a light bulb receptacle at one end and wire engaging prongs at the other. The prongs extend out a bottom surface of the base into a wire receiving channel. The assembly also includes a support (such as a stake or post) for supporting the base above a surface. The fixture and support are connected together by twist lock connector means.

In one preferred embodiment, the twist lock connector means rotationally connects the base to an upper end of the support. Light fixtures in accordance with the present invention are positively locked to the support with less than approximately a 90° rotation of the support with respect to the base. Although the wire lies between the support and the fixture, rotational movement of the support and base with respect to one another is facilitated without impediment to the twist lock connectors by the wire. Since the prongs also pierce and secure the wire while the locking means is frictionally engaged against the wire and itself, an expansive force is produced. The twist lock connector means, therefore, is secure against tampering once it is engaged.

DETAILED DESCRIPTION OF THE PREFERRED EMBODIMENTS

Figure 1:
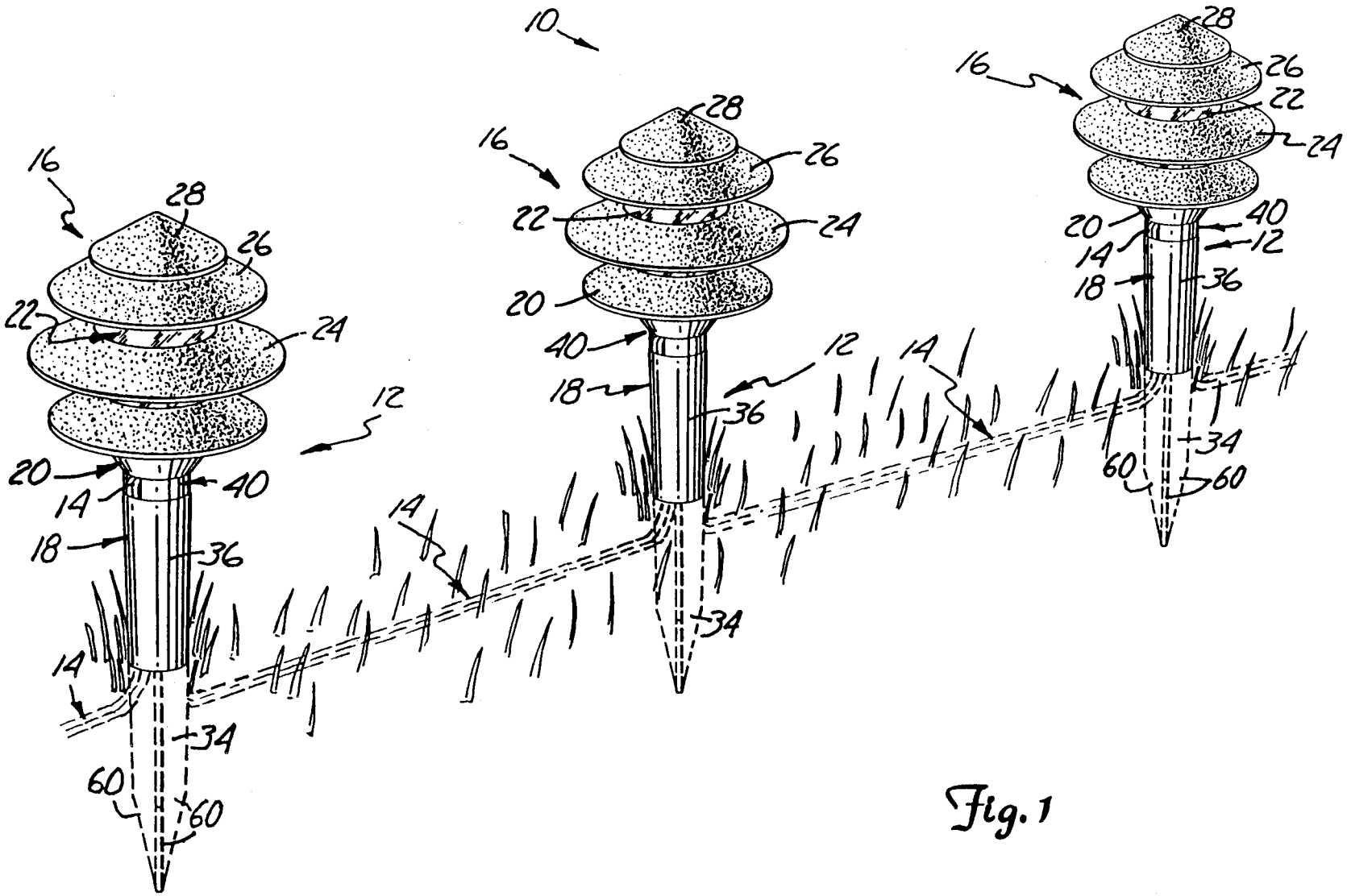
FIG. 1 is a perspective view of an outdoor lighting system which includes a plurality of low voltage light fixtures.
Figure 2:
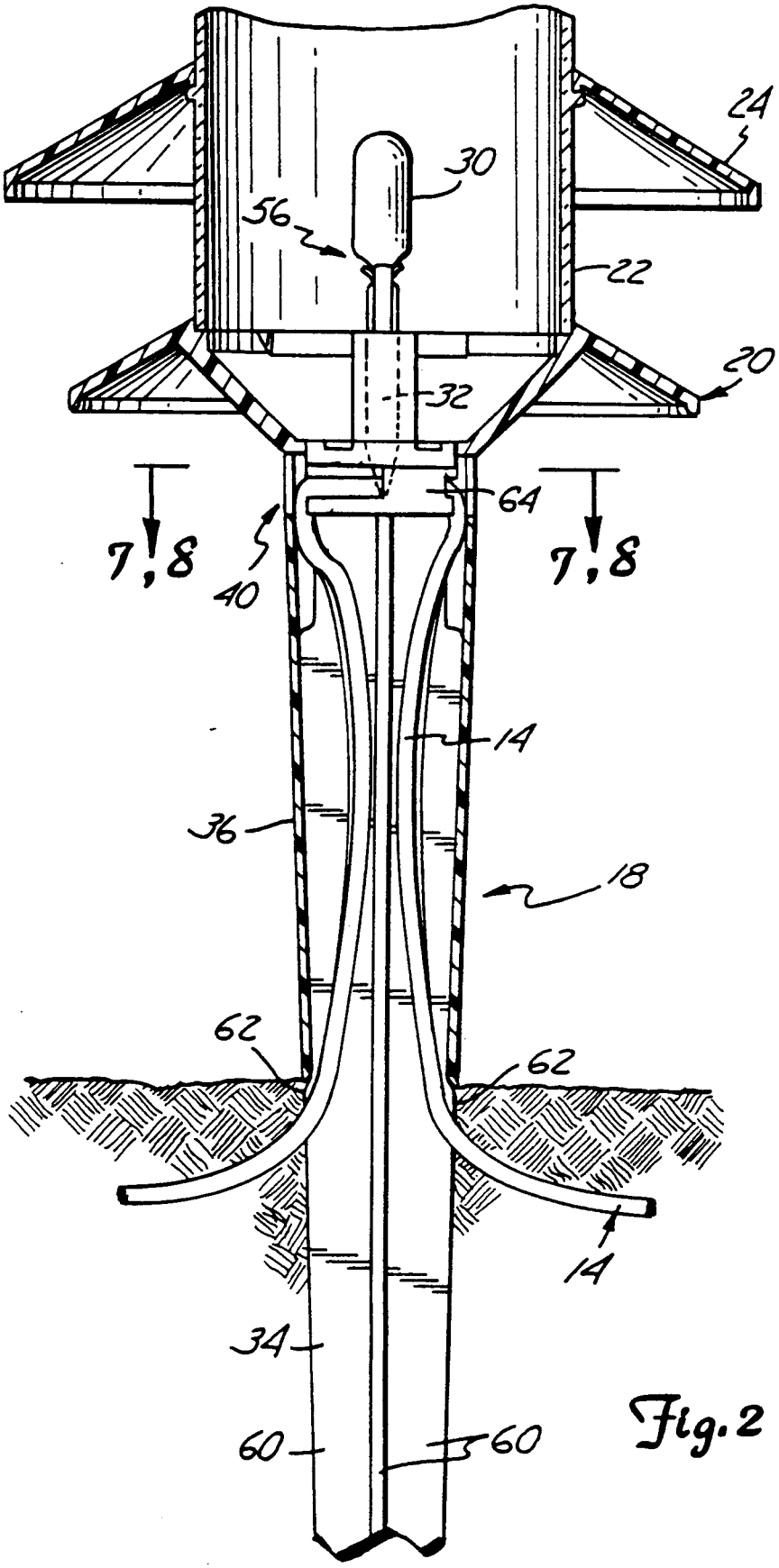
FIG. 2 is a sectional view of the low voltage light fixture shown in FIG. 1 inserted into the ground with upper portions cut away to illustrate how the fixture head is connected to the stake.

FIG. 1 shows an outdoor lighting system 10 which includes a plurality of light fixtures 12 connected together by a two-conductor plastic-coated electrical wire 14. At one end, wire 14 is connected to a power pack (not shown) which typically includes a step-down transformer and a timer control. Wire 14 extends below ground and is fed up into each light fixture 12 (as best shown in FIG. 2) to connect light fixtures 12 in parallel.

Each light fixture 12 includes a head unit 16 Which is mounted at a top end of a vertical support 18. In the embodiment illustrated in FIGS. 1–4, each head unit 16 is a pagoda-style fixture head which includes base 20, lens 22, center shade or tier 24, top shade or tier 26, top cap 28, lamp 30 and lamp/wire interconneot conductors 32. Support 18 includes stake 34 and sleeve 36. As will be described in more detail later, wire 14, head unit 16 and support 18 are joined together by the twist lock connection mechanism 40 of the present invention, which is located at the bottom end of the base 20 and the top end of the stake 34. Sleeve 36 covers the portion of wire 14 which extends above ground.

Base 20 is preferably an integral plastic unit which includes bottom shade or tier 42, frustoconical center 44, lamp support 46, skirts 48A and 48B and L-shaped connector legs 50A and 50B.

Figure 5:
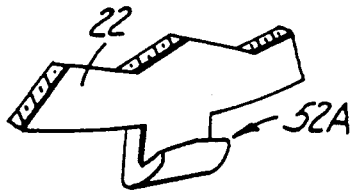
FIG. 5 is an exploded cutaway view of a lens connection tab.
Figure 4:
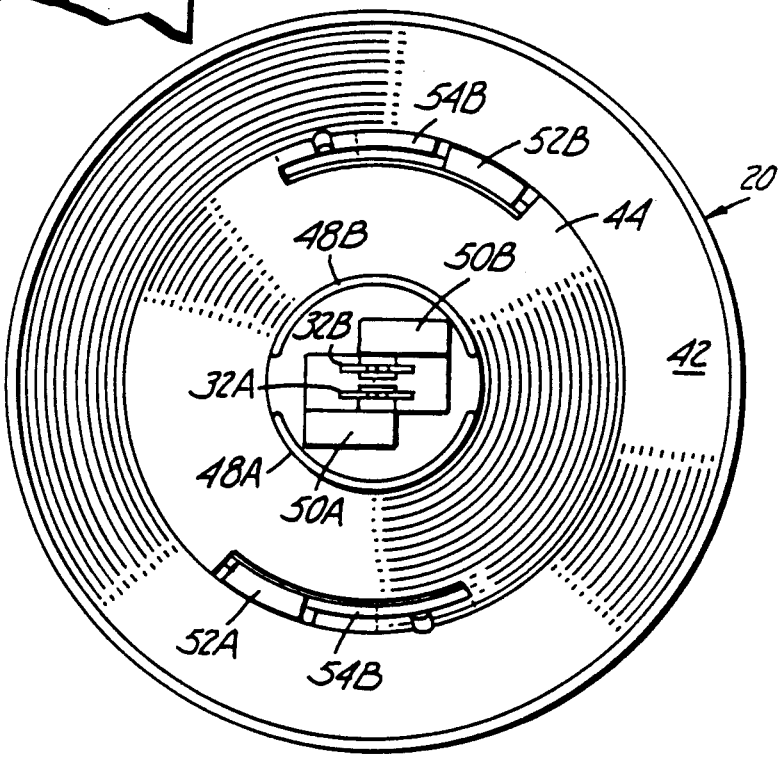
FIG. 4 is a bottom view of the base of the fixture head.

Base 20 is connectable at its uppermost rim to the lower rim of lens 22. In the embodiment illustrated in FIGS. 4 and 5, lens 22 includes a pair of tabs 52A and 52B positioned on opposite sides of lens 22. Each tab 52A and 52B includes a downwardly extending support portion and an upwardly and outwardly extending flange portion receivable in slots 54A and 54B on base 20. Lens 22 is secured to base 20 by inserting tabs 24A and 52B into slots 54A and 54B then rotating lens 22 relative to base 20 until tabs 52A, 52B are secured in the narrower portions of slots 54A, 54B.

Electrical conductors 32 are carried by base 22 and extend through support 46 to connect lamp 30 to wire 14. Conductors 32 have sharp prongs 32A and 32B at their lower ends extending below the bottom surface of base 20 to engage and hold wire 14. Conductors 32 also form a light bulb receptacle 56 at their upper ends.

Figure 3:
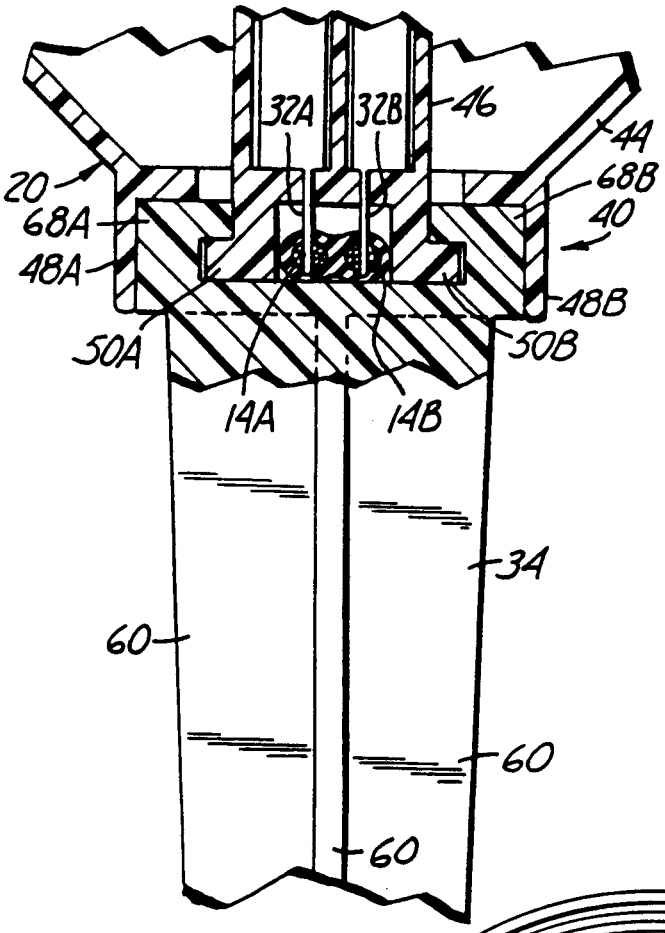
FIG. 3 is a partial sectional view of the bottom surface of the base connected with the upper end of the stake and with the wire and the conductor prongs engaged.

As illustrated in FIGS. 1–3, stake 34 has a plurality of blades 60 which form a "+" or "X" cross section. Blades 60 taper to a point at the lower end of stake 34. Blades 60 include a shoulder 62 (FIG. 2) to hold sleeve 36 in position over the upper portion of stake 34. Sleeve 36 is a slightly tapered tube which is sized to cover stake 34 and to protect and conceal wire 14.

Figure 6:
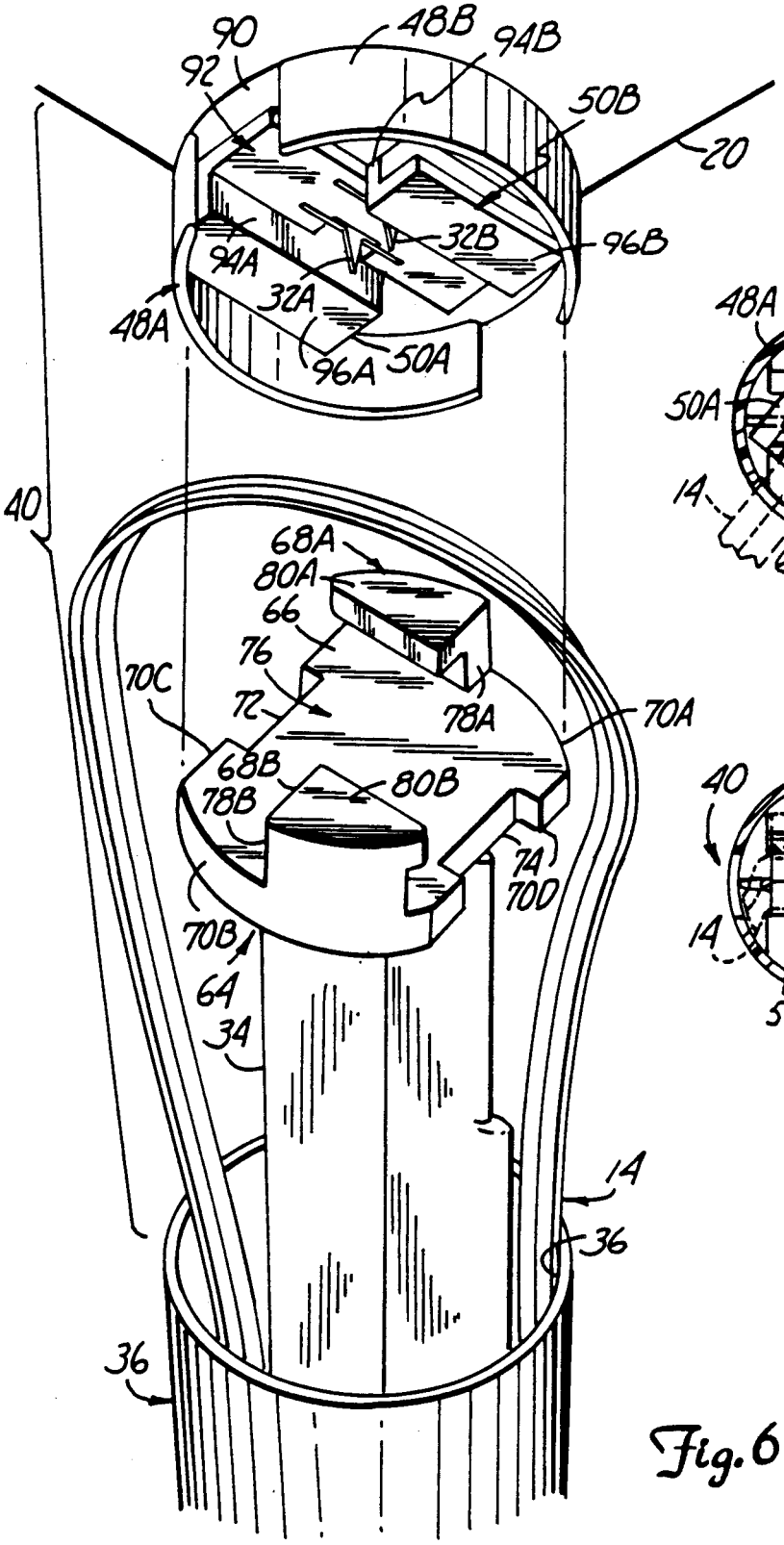
FIG. 6 is an exploded view of the fixture shown in FIG. 1, along with a wire, to illustrate where the locking connection is made.
Figure 7:
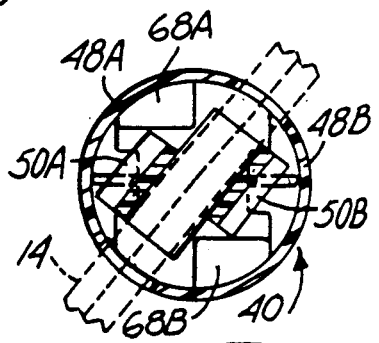
FIGS. 7 and 8 are sectional views illustrating how connection is made between the base and the stake.
Figure 8:
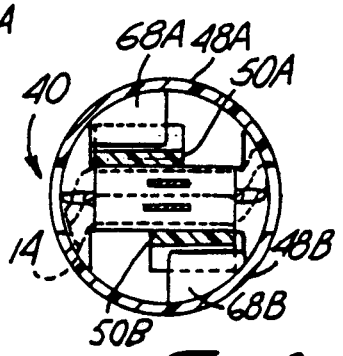

The twist lock connection mechanism for connecting base 20 to the upper end of stake 34 is illustrated in more detail FIGS. 6–8. Upper end 64 of stake 34 has a top plate 66 with a pair of upstanding diagonally opposed L-shaped connector legs 68A and 68B extending above plate 66. Top plate 66 has a pair of curved sides 70A and 70B separated by a pair of notched sides 70C and 70D. A first rectangular notch 72 is located inside 70C, and a second rectangular notch 74 is located in side 70D. Wire 14 is received in notches 72 and 74 and extends across top plate 66 in a channel 76 formed between legs 68A and 68B.

Connector legs 68A and 68B each have a vertical support portion 78A, 78B and an inwardly extending horizontal flange portion 80A, 80B.

Connector legs 50A and 50B of base 20 mate with connection legs 68A and 68B of stake 34 to provide a twist lock connection. Connector legs 50A and 50B are attached to a bottom surface 90 of base 20 and are spaced to define a first channel 92 between them. Connector legs 50A and 50B each are L-shaped legs having a vertical support portion 94A, 94B and outwardly extending horizontal flange portions 96A, 96B. Connector legs 50A and 50B are positioned diagonally on opposite sides of channel 92. Connectors legs 50A, 50B of base 20 (which form a first twist lock connector) and connector legs 68A, 68B of stake 34 (which form a second twist lock connector) are capable of mating engagement with each other when stake 34 and base 20 are rotated relative to one another from a first position shown in FIG. 7 to a second position shown in FIG. 8. The difference between position the first and second positions is less than 90°. The connectors mate preferably in a bayonet mount fashion and lock in the second position by frictional engagement.

To assemble low voltage light fixture 12, wire 14 is first drawn through a lower end of sleeve 36 in a looped manner and then placed over the sharp points of prongs 32A and 32B. Wire 14 next is pressed down until prongs 32A and 32B come into conductive contact with the conductors 14A and 14B of wire 14. Stake 34 is then positioned over base 20 to form a wire "tunnel" as shown in FIG. 7. Stake 34 and base 20 are then rotated relative to one another from the first position (FIG. 7) to the second position (FIG. 8). Rotational movement of stake 34 and base 20 relative to one another is not impeded by wire 14. Twist lock connectors legs 50A, 50B and 68A, 68B mate in a bayonet mount fashion and lock by frictional engagement in the second position shown in FIG. 8. Once prongs 32A and 32B have penetrated wire 14, and the twist lock connector legs 50A, 50B and 68A, 68B are engaged, a positive lock is achieved. Attempts to detach head unit 16 from stake 34 are frustrated by the frictional engagement of twist lock connector leg 50A, 50B and 68A, 68B against one another, the pierced-engagement of wire 14 by prongs 32A and 32B, and an expansive force produced by wire 14.

After the connection is made, stake 34 is inserted into the ground. Wire 14 is then connected to an appropriate low voltage power source, perhaps through or in conjunction with additional similar light fixtures.

Although the present invention has been described with reference to preferred embodiments, workers skilled in the art will recognize that changes can be made in form and detail without departing from the spirit and scope of the invention. For Example, head units 16 can take a variety of different shapes and forms, with different lens and housing configurations.

What is claimed is:

1. In a low voltage light fixture for use with a multi-conductor wire, having a base, a lens supported by the base, a pair of electrical conductors supported by the base and forming a light bulb receptacle at upper ends and wire engaging prongs at lower ends, and having a support for supporting the base, the improvement comprising:

a first twist lock connector attached to a bottom surface of the base which includes a first pair of spaced connector elements, the first connector elements defining a first channel between them in which the wire is received and held and in which the prongs extend, and being positioned diagonally with respect to the first channel; and a second twist lock connector attached to the upper end of the stake which includes a second pair of connector elements, the second pair of elements defining a second channel between them and positioned diagonally with respect to the second channel, wherein (a) the second pair of spaced connector elements engage the first pair of spaced connector elements, (b) a passage, through which the wire extends, is formed by the first and second channels and maintained, and (c) the prongs electrically engage the wire, when the stake and base are rotated relative to one another.

2. The fixture of claim 1 wherein the first pair of connector elements are L-shaped legs having a flange portion extending outwardly and a support portion with a inwardly facing surface.

3. The fixture of claim 1 wherein the second pair of connector elements are L-shaped legs having a flange portion extending inwardly and a support portion with a outwardly facing surface.

4. The fixture of claim 1 wherein frictional engagement of the second twist lock connector with the first twist lock connector and against the wire produces an expansive force which tends to hold the first and second twist lock connectors in a locked position.

5. The fixture of claim 1 wherein a skirt is attached to the base and extends at least partially around the first twist lock connector.

6. The fixture of claim 1 wherein the second twist lock connector includes first and second connector elements separated diagonally across the second channel.

7. The fixture of claim 6 wherein the upper end of the stake includes notches positioned to receive the wire.

8. The fixture of claim 1 and further comprising a sleeve positionable over an upper portion of the support to cover and protect portions of the wire leading to and from the first and second twist lock connectors.

9. A low voltage light fixture for use with a multiconductor wire, the light fixture comprising:

a light fixture head having a first pair of twist lock connector elements which define a first wire receiving channel and having wire engaging conductors which extend into the first wire receiving channel; and a support for supporting the light fixture, the support having a second pair of twist lock connector elements which define a second channel and which engage the first pair of twist lock connector elements to connect together the light fixture head and the support.

10. The fixture of claim 9 wherein the first and second pair of twist lock connector elements connect the base to an upper end of the support when rotated with respect to one another from a first position to a second position.

11. The fixture of claim 10 wherein the first and second positions are less than approximately 90° apart.

12. The fixture of claim 9 wherein the first pair of connector elements are L-shaped legs having a flange portion extending outwardly and a support portion with a inwardly facing surface.

13. The fixture of claim 9 wherein the second pair of connector elements are L-shaped legs having a flange portion extending inwardly and a support portion with a outwardly facing surface.

14. The fixture of claim 9 wherein the first pair of twist lock connector elements and the second pair of twist lock connector elements mate in a bayonet mount fashion forming a wire passage and lock by frictional engagement.

15. The fixture of claim 9 wherein a skirt is attached to the base and extends at least partially around the first pair of twist lock connector elements.

16. The fixture of claim 9 wherein the second pair of twist lock connector elements are separated diagonally across the second channel.

17. The fixture of claim 16 wherein the support has an upper end with notches, positioned to receive the wire.

18. The fixture of claim 9 wherein the support has a plurality of blades which form a X-shaped cross section.

19. The fixture of claim 13 wherein at least two blades of the support project outward near an upper portion of the support forming a shoulder, and all the blades project outward near a median of the support and taper to a point at a lower end.

20. The fixture of claim 19 and further comprising a sleeve positionable on the shoulder of the support to cover and protect portions of the wire leading to and from the first and second twist lock connectors.

21. The fixture in claim 20 wherein the sleeve is tapered.

* * * * *